US011499380B2

(12) United States Patent
Fraczek et al.

(10) Patent No.: US 11,499,380 B2
(45) **Date of Patent: *Nov. 15, 2022**

(54) INTEGRAL DSIT AND FLOW SPOOL

(71) Applicant: Ameriforge Group Inc., Houston, TX (US)

(72) Inventors: Justin Fraczek, Houston, TX (US); Waybourn Anderson, Houston, TX (US); Alex Gidman, Houston, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/088,921

(22) Filed: Nov. 4, 2020

(65) Prior Publication Data

US 2021/0115738 A1 Apr. 22, 2021

Related U.S. Application Data

(63) Continuation of application No. 16/841,282, filed on Apr. 6, 2020, now Pat. No. 10,837,239, which is a continuation of application No. 15/947,266, filed on Apr. 6, 2018, now Pat. No. 10,612,317.

(60) Provisional application No. 62/482,580, filed on Apr. 6, 2017.

(51) Int. Cl.

| | |
|---|---|
| ***E21B 17/01*** | (2006.01) |
| ***E21B 21/00*** | (2006.01) |
| ***E21B 21/08*** | (2006.01) |
| ***E21B 21/10*** | (2006.01) |
| ***E21B 33/08*** | (2006.01) |

(52) U.S. Cl.
CPC ..... *E21B 17/01* (2013.01); *E21B 21/08* (2013.01); *E21B 21/106* (2013.01); *E21B 33/085* (2013.01)

(58) Field of Classification Search
CPC ..... E21B 17/01; E21B 21/08; E21B 21/106; E21B 33/085
See application file for complete search history.

(56) References Cited

U.S. PATENT DOCUMENTS

| | | | |
|---|---|---|---|
| 4,183,562 | A | 1/1980 | Watkins et al. |
| 4,210,208 | A | 7/1980 | Shanks |

(Continued)

FOREIGN PATENT DOCUMENTS

| | | |
|---|---|---|
| BR | 112015021587 | 7/2017 |
| WO | WO 86/02696 | 5/1986 |

(Continued)

OTHER PUBLICATIONS

Extended European Search Report Issue in Application No. 14791083, dated Jan. 5, 2017.

(Continued)

*Primary Examiner* — Matthew R Buck
(74) *Attorney, Agent, or Firm* — Norton Rose Fulbright US LLP

(57) ABSTRACT

This disclosure includes riser-component assemblies and methods of assembling the same that are suitable for managed pressure drilling (MPD) systems. For example, this disclosure includes integrated flow spool and isolation tool riser components that can be permanently coupled together and that can be configured to pass through a rotary table or other rig equipment.

25 Claims, 10 Drawing Sheets

(56) References Cited

U.S. PATENT DOCUMENTS

| | | | | |
|---|---|---|---|---|
| 4,444,401 | A * | 4/1984 | Roche | E21B 21/001 166/363 |
| 4,987,956 | A | 1/1991 | Hansen | |
| 7,237,623 | B2 | 7/2007 | Hannegan | |
| 7,347,455 | B1 | 3/2008 | Taquino | |
| 8,127,854 | B2 | 3/2012 | Haheim | |
| 8,317,234 | B2 | 11/2012 | McKay | |
| 8,413,724 | B2 * | 4/2013 | Carbaugh | E21B 17/085 166/345 |
| 8,528,647 | B2 | 9/2013 | Guesnon et al. | |
| 8,783,359 | B2 | 7/2014 | Reed | |
| 8,863,845 | B2 | 10/2014 | Gilmore et al. | |
| 8,960,302 | B2 | 2/2015 | Shilling et al. | |
| 9,074,425 | B2 | 7/2015 | Feasey | |
| 9,109,420 | B2 * | 8/2015 | Tindle | E21B 7/12 |
| 9,121,227 | B2 | 9/2015 | Thommesen | |
| 9,428,975 | B2 | 8/2016 | Stave et al. | |
| 9,765,587 | B2 * | 9/2017 | Boulanger | E21B 33/064 |
| 9,803,443 | B2 * | 10/2017 | Tindle | E21B 7/12 |
| 9,909,379 | B2 | 3/2018 | Fraczek et al. | |
| 9,970,247 | B2 | 5/2018 | Fraczek et al. | |
| 10,012,031 | B2 | 7/2018 | Fraczek et al. | |
| 10,012,044 | B2 * | 7/2018 | Leba | E21B 17/085 |
| 10,612,317 | B2 * | 4/2020 | Fraczek | E21B 17/01 |
| 10,655,403 | B2 | 5/2020 | Fraczek | |
| 10,689,929 | B2 | 6/2020 | Fraczek et al. | |
| 10,837,239 | B2 * | 11/2020 | Fraczek | E21B 21/08 |
| 2002/0014340 | A1 | 2/2002 | Johnson | |
| 2008/0264644 | A1 | 10/2008 | Sawtell | |
| 2009/0260831 | A1 | 10/2009 | Moksvold | |
| 2010/0300699 | A1 | 12/2010 | Papon et al. | |
| 2011/0017466 | A1 | 1/2011 | Averbuch et al. | |
| 2011/0073315 | A1 | 3/2011 | Guesnon et al. | |
| 2011/0209876 | A1 | 9/2011 | Reed et al. | |
| 2011/0225789 | A1 | 9/2011 | Darnell | |
| 2011/0253445 | A1 | 10/2011 | Hannegan et al. | |
| 2012/0037377 | A1 | 2/2012 | Walker | |
| 2012/0055677 | A1 * | 3/2012 | Boyd | E21B 19/004 166/350 |
| 2012/0132432 | A1 | 5/2012 | Carbaugh et al. | |
| 2012/0312544 | A1 | 12/2012 | Tavner et al. | |
| 2013/0043036 | A1 | 2/2013 | Kotrla et al. | |
| 2013/0161021 | A1 | 6/2013 | Makosey et al. | |
| 2014/0193282 | A1 | 7/2014 | Stave et al. | |
| 2014/0209316 | A1 | 7/2014 | Tindle et al. | |
| 2014/0262313 | A1 * | 9/2014 | Gilmore | E21B 17/006 166/363 |
| 2015/0096759 | A1 | 4/2015 | Gilmore | |
| 2016/0032662 | A1 | 2/2016 | Walker et al. | |
| 2016/0076312 | A1 * | 3/2016 | Fraczek | E21B 17/01 166/367 |
| 2016/0076323 | A1 * | 3/2016 | Fraczek | E21B 21/10 166/367 |
| 2016/0138352 | A1 | 5/2016 | Leba et al. | |
| 2017/0067295 | A1 | 3/2017 | Gilmore et al. | |
| 2018/0245416 | A1 | 8/2018 | Fraczek et al. | |

FOREIGN PATENT DOCUMENTS

| | | |
|---|---|---|
| WO | WO 2013/024354 | 2/2013 |
| WO | WO 2014/151724 | 9/2014 |
| WO | WO 2014/179532 | 11/2014 |
| WO | WO 2014/179538 | 11/2014 |
| WO | 2992166 | 3/2016 |

OTHER PUBLICATIONS

Frink, "Managed Presser drilling—what's in a name?" Drilling Contractor, Mar./Apr. 2006, 36-39.

International Preliminary Report on Patentability Issued in Corresponding PCT Application No. PCT/US2018/026513, dated Oct. 8, 2019.

International Preliminary Report on Patentability Issued in Corresponding PCT Application No. PCT/US2018/026518, dated Oct. 8, 2019.

International Search Report and Written Opinion issued in International Patent Application No. PCT/US2018/026513, dated Jun. 28, 2018.

International Search Report and Written Opinion issued in International Patent Application No. PCT/US2018/026518, dated Jul. 2, 2018.

International Search Report and Written Opinion Issued in PCT/US2014/036309, dated Sep. 4, 2014.

Office Action Issued in Corresponding Brazilian Patent No. BR112015027634-2, dated Apr. 17, 2020.

* cited by examiner

INTEGRAL DSIT AND FLOW SPOOL

CROSS-REFERENCE TO RELATED APPLICATIONS

This application is a continuation application of U.S. application Ser. No. 16/841,282, filed Apr. 6, 2020, which is a continuation application of U.S. application Ser. No. 15/947,266, filed on Apr. 6, 2018, now U.S. Pat. No. 10,612,317 which claims priority to U.S. Provisional Application No. 62/482,580, filed Apr. 6, 2017, the entire contents of which applications are specifically incorporated by reference herein without disclaimer.

FIELD OF INVENTION

The present invention relates generally to riser assemblies suitable for offshore drilling and more particularly, but not by way of limitation, to integrated components of a riser assembly.

BACKGROUND

Offshore drilling operations have been undertaken for many years. Traditionally, pressure within a drill string and riser pipe have been governed by the density of drilling mud alone. More recently, attempts have been made to control the pressure within a drill string and riser pipe using methods and characteristics in addition to the density of drilling mud. Such attempts may be referred to in the art as managed pressure drilling (MPD). See, e.g., Frink, *Managed pressure drilling-what's in a name?*, Drilling Contractor, March/April 2006, pp. 36-39.

SUMMARY

MPD techniques generally require additional or different riser components relative to risers used in conventional drilling techniques. These new or different components may be larger than those used in conventional techniques. For example, riser segments used for MPD techniques may utilize large components that force auxiliary lines to be routed around those components, which can increase the overall diameter or transverse dimensions of riser segments relative to riser segments used in conventional drilling techniques. However, numerous drilling rigs are already in existence, and it is generally not economical to retrofit those existing drilling rigs to fit larger-diameter riser segments.

Currently, MPD riser segment assemblies and/or components with an overall diameter or other transverse dimension that is too large to fit through a rotary or rotary table of a drilling rig must be loaded onto the rig below the deck (e.g., on the mezzanine level) and moved laterally into position to be coupled to the riser stack below the rotary. This movement of oversize components is often more difficult than vertically lowering equipment through the rotary from above (e.g., with a crane). Solutions to these problems for isolation tool components and flow spool components can found in U.S. patent application Ser. No. 14/888,894 and PCT/US2014/036309, respectively. Although isolation tools and flow spools are frequently used together in MPD riser segment assemblies, they are conventionally manufactured as separate components and coupled together when making up the riser assembly. In addition to the extra time and effort required to couple the isolation tool and flow spool together, the assembly generally also requires extra material in form of connection pieces, such as flanges, to couple these components together. At least some of the embodiments of the present invention can address these issues by permanently coupling the isolation tool and flow spool directly to one another (e.g., via welding). In some embodiments, the isolation tool and flow spool are permanently coupled before being shipping to the well or drill site. In some embodiments the flow spool component can be similar to a flow spool component like that disclosed in PCT/US2014/036309, which is incorporated herein in its entirety. In some embodiments, the isolation tool can be an isolation tool like that disclosed in U.S. patent application Ser. No. 14/888,894, each of which are incorporated herein in their entireties. In some embodiments, the combined isolation tool and flow spool component (also referred to herein as an integral isolation tool and flow spool component) can fit through a rotary table.

In some embodiments of the present riser-component assemblies having a primary lumen, the assembly comprises: a first flange (the first flange comprising: a first mating face configured to mate with a flange of a first adjacent riser segment, and a first central flange lumen in fluid communication with the primary lumen); a housing permanently coupled to the first flange, the housing having a first opening, a second opening, and a central chamber in fluid communication with the primary lumen and configured to receive an annular seal around a primary axis extending through the first and second openings such that the annular seal can selectively seal an annulus in the housing around a drill string extending through the first and second openings; a second flange (the second flange comprising: a second mating face configured to mate with a flange of a second adjacent riser segment, and a second central flange lumen in fluid communication with the primary lumen); and a flow diverter permanently coupled to the second flange between the housing and the second flange, the flow diverter having a collar defining a lateral opening in fluid communication with the primary lumen, the collar having a collar lumen in fluid communication with the primary lumen, a main tube having a main tube lumen in fluid communication with the primary lumen, and a valve in fluid communication with the lateral opening, the valve having a longitudinal flow axis that is more parallel than perpendicular to a longitudinal axis extending through the first and second central flange lumens of respective first and second flanges. Some embodiments further comprise: the annular seal. In some embodiments, the main tube is unitary with the collar. In some embodiments, the flow diverter and housing are permanently coupled together. In some embodiments, the valve comprises a double ball valve.

In some embodiments of the present riser-component assemblies, the flow diverter further comprises a fitting coupled to the valve and to the collar over the lateral opening, the fitting defining a fitting lumen in fluid communication with the lateral opening. Some embodiments further comprise: a first connector secured to the fitting and to a first end of the valve, and a second connector secured to a second end of the valve.

Some embodiments of the present riser-component assemblies further comprise: a first flow line with a first flow line lumen in fluid communication with the lateral opening, the first flow line having a first end. In some embodiments, the first flow line lumen has an inlet through which fluid can enter in a first direction substantially parallel to the longitudinal flow axis of the valve, and an outlet through which fluid may exit in a second direction, the second direction substantially different than the first direction. In some embodiments, the first flow line further comprises curvilinear portions configured to change direction of fluid flow through the first flow line lumen without increasing the maximum transverse diameter of the first flow line. In some embodiments, the first flow line can include a curved portion (e.g., a gooseneck portion) that may increase the maximum transverse diameter of the first flow line. Such curved portion may be removable such that it can be attached to the first flow line after the rest of riser-component assembly passes through a rotary. Such curved portion may include handles that provide protection from inadvertent contact to the curved portion. In some embodiments, the second connector further comprises a recess configured to receive the first end of the first flow line without threads or welding to permit fluid communication between the first flow line lumen and the valve. In some embodiments, the first flow line has a second end, the second end having a flow line flange configured to be coupled a second flow line. In some embodiments, no transverse portion of any of the flow diverter and first flow line extends beyond the maximum transverse dimension of the housing. In some embodiments, the housing further comprises a peripheral portion defining a first passage that is distinct from the first opening, second opening, and central chamber, and configured to receive a first portion of the first flow line. Some embodiments further comprise: a spacer collar permanently coupled to the second flange and housing.

In some embodiments of the present riser-component assemblies, the first flow line is configured to be coupled to the main tube by a retainer. In some embodiments, the retainer includes a body having a passage configured to receive a first portion of the first flow line to restrict lateral movement of the first flow line relative to the main tube. In some embodiments, no transverse portion of any of the flow diverter, first flow line, and retainer extends beyond the maximum transverse dimension of the housing. In some embodiments, the maximum transverse dimension of the housing is less than 60.5 inches. In some embodiments, the housing further comprises a peripheral portion defining a first passage that is distinct from the first opening, second opening, and central chamber, and configured to receive a second portion of the first flow line, where the second portion is distinct from the first portion.

In some embodiments of the present riser-component assemblies, the second flange further comprises a peripheral portion defining a first peripheral flange lumen, the first peripheral flange lumen configured to receive a portion of a pin end a second flow line, the second flow line having a second flow line lumen. Some embodiments further comprise a third flange configured to be coupled to the second flange, the third flange having: a third mating face configured to mate with the second mating face of the second flange; a peripheral portion defining a second peripheral flange lumen, the second peripheral flange lumen configured to receive a portion of the pin end of the second flow line, where the pin end extends through the first and second peripheral flange lumens; and a third flange central lumen configured to be in fluid communication with the primary lumen when the third flange is coupled to the second flange. In some embodiments, the pin end of the second flow line is configured to be coupled to a second end of the first flow line such that the second flow line lumen and first flow line lumen are in fluid communication. In some embodiments, the pin end of the second flow line is configured to be received within a recess of a box connector on the second end of the first flow line. Some embodiments further comprise: a diversion collar permanently coupled to the third flange on a side opposite the third mating face, the diversion collar defining a diversion collar lumen having an inlet through which fluid can enter in a first direction and an outlet through which fluid can exit in a second direction that is different than the first direction, the inlet configured to be coupled to a second end of the second flow line, where the second end is not the pin end.

In some embodiments of the present riser-component assemblies, the valve is further configured to be coupled to a choke line or a kill line, the choke line or kill line configured to prevent fluid flow past the valve when actuated.

Some embodiments of the present methods comprise: lowering an embodiment of the present riser-component assemblies through a rotary of a drilling rig.

In some embodiments of the present methods of assembling a riser-component having a primary lumen, the method comprises: permanently coupling a first flange to a housing, the first flange having a first central flange lumen in fluid communication with the primary lumen and a first mating face configured to mate with a flange of a first adjacent riser segment, and the housing having a first opening, a second opening, and central chamber in fluid communication with the primary lumen; permanently coupling a second flange to a flow diverter, the second flange having a second central flange lumen in fluid communication with the primary lumen and a second mating face configured to mate with a flange of a second adjacent riser segment, and the flow diverter having a collar defining a lateral opening in fluid communication with the primary lumen and having a collar lumen in fluid communication with the primary lumen, a main tube having a main tube lumen in fluid communication with the primary lumen, and a valve in fluid communication with the lateral opening; and permanently coupling the housing to the flow diverter.

Some embodiments of the present methods further comprise: receiving within the central chamber an annular seal around a primary axis extending through the first and second openings such that the annular seal can selectively seal an annulus in the housing around a drill string extending through the first and second openings. In some embodiments, the valve comprises a longitudinal flow axis that is more parallel than perpendicular to a longitudinal axis extending through the first and second central flange lumens of respective first and second flanges. Some embodiments further comprise: coupling a fitting to the valve and to the collar over the lateral opening, the fitting defining a fitting lumen in fluid communication with the lateral opening. Some embodiments further comprise: securing a first connector to the fitting and to a first end of the valve, and securing a second connector to a second end of the valve that is different than the first end of the valve. Some embodiments further comprise: coupling a first end of a first flow line to the valve, the first flow line having a first flow line lumen in fluid communication with the lateral opening. Some embodiments further comprise: receiving the first end of the first flow line within a recess of the second connector without threads or welding, such that there is fluid communication between the first flow line lumen and the valve. In some embodiments, no transverse portion of any of the flow diverter and first flow line extends beyond the maximum transverse dimension of the housing.

Some embodiments of the present methods further comprise: receiving a first portion of the first flow line within a passage of a peripheral portion of the housing, where the passage is distinct from the first opening, second opening, and central chamber. Some embodiments further comprise: coupling the first flow line to the main tube by a retainer.

Some embodiments further comprise: receiving a first portion of the first flow line within a passage of a body of the retainer such that lateral movement of the first flow line relative to the main tube is restricted. In some embodiments, no transverse portion of any of the flow diverter, first flow line, and retainer extends beyond the maximum transverse dimension of the housing. In some embodiments, the maximum transverse dimension of the housing is less than 60.5 inches. Some embodiments further comprise: receiving a second portion of the first flow line within a passage of a peripheral portion of the housing, where the passage is distinct from the first opening, second opening, and central chamber, and the second portion of the first flow line is distinct from the first portion of the first flow line. Some embodiments further comprise: permanently coupling a spacer collar to the second flange and housing.

Some embodiments of the present methods further comprise: receiving a portion of a pin end of a second flow line within a first peripheral flange lumen of a peripheral portion of the second flange, the second flow line having a second flow line lumen. Some embodiments further comprise: coupling a third mating face of a third flange to the second mating face of the second flange, such that a third flange central lumen of the third flange is in fluid communication with the primary lumen, and such that a portion of the pin end of the second flow line is received within a second peripheral flange lumen of a peripheral portion of the third flange. Some embodiments further comprise: coupling the pin end of the second flow line to a second end of the first flow line such that the second flow line lumen is in fluid communication with the first flow line lumen. Some embodiments further comprise: further comprising receiving the pin end of the second flow line within a recess of a box connector on the second end of the first flow line. Some embodiments further comprise: permanently coupling a diversion collar to the third flange on a side opposite the third mating face, the diversion collar defining a diversion collar lumen having an inlet through which fluid can enter in a first direction and an outlet through which fluid can exit in a second direction that is different than the first direction; and coupling the inlet of the diversion collar to a second end of the second flow line, where the second end is not the pin end. Some embodiments further comprise: coupling a choke line or a kill line to the valve, where the choke line or kill line is configured to prevent fluid flow past the valve when actuated.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments are described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale for at least the embodiments shown.

DESCRIPTION OF ILLUSTRATIVE EMBODIMENTS

Figure 1:
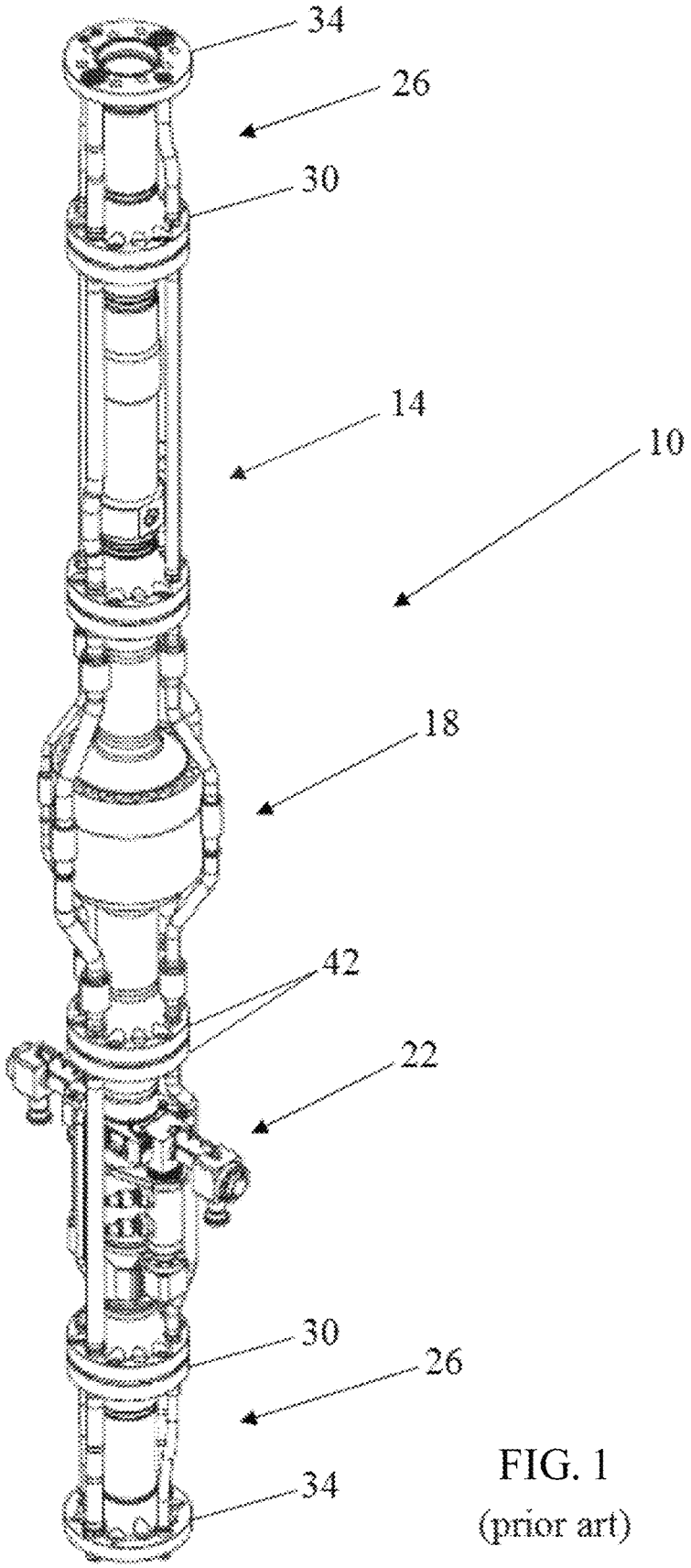
FIG. 1 (prior art)
FIG. 1 depicts a perspective view of a prior art riser stack including an isolation tool and flow spool.

Referring now to the drawings, and more particularly to FIG. 1, shown there and designated by the reference numeral 10 is a prior art riser assembly or stack that includes multiple riser components. As shown, assembly 10 includes a rotating control device (RCD) body component 14, an isolation unit component 18, a flow spool component 22, and two cross-over components 26 (one at either end of assembly 10). Isolation unit component 18 and flow spool component 22 are coupled together by joining flanges 42. FIGS. 2A-3G described below illustrate embodiments of an integral isolation tool and flow spool riser-component that does not require flanges 42 when used in a riser-component assembly or stack.

Figure 2A:
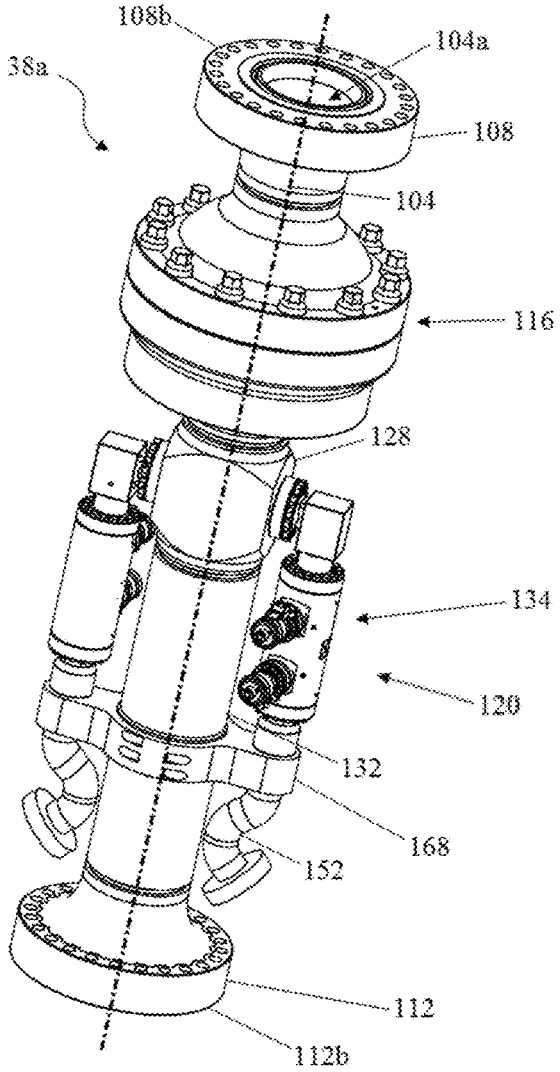
FIG. 2A depicts a perspective view of an embodiment of the present riser-component assemblies that includes an integral isolation tool and flow spool component.

FIG. 2A shows integral riser-component assembly 38*a*, which comprises a first flange 108, a housing 116, a flow spool 120, and a second flange 112. Flanges 108, 112 can include mating faces 108*b*, 112*b*, respectively, that can be configured to mate with adjacent riser segments. Flange 108 can be permanently coupled (e.g., by welding) to housing 116, housing 116 can be permanently coupled to flow spool 120, and flow spool 120 can be permanently coupled to flange 112. As used herein, the term "permanently coupled" means not easily removable and includes coupling by welding, but does not include coupling by only removable fasteners (e.g., screws, bolts) or coupling by only removable threading (e.g., threading on the interior and/or exterior of adjacent tubulars). Integral riser-component assembly 38*a* can include primary axis 104 and primary lumen 104*a*, which can be in fluid communication with a lumen of adjacent riser-components. Flow spool 120 can include collar 128, main tube 132, valve assemblies 134, first flow lines 152 and retainer 168, as described more fully with reference to FIGS. 2B and 2E-F below.

Figure 2B:
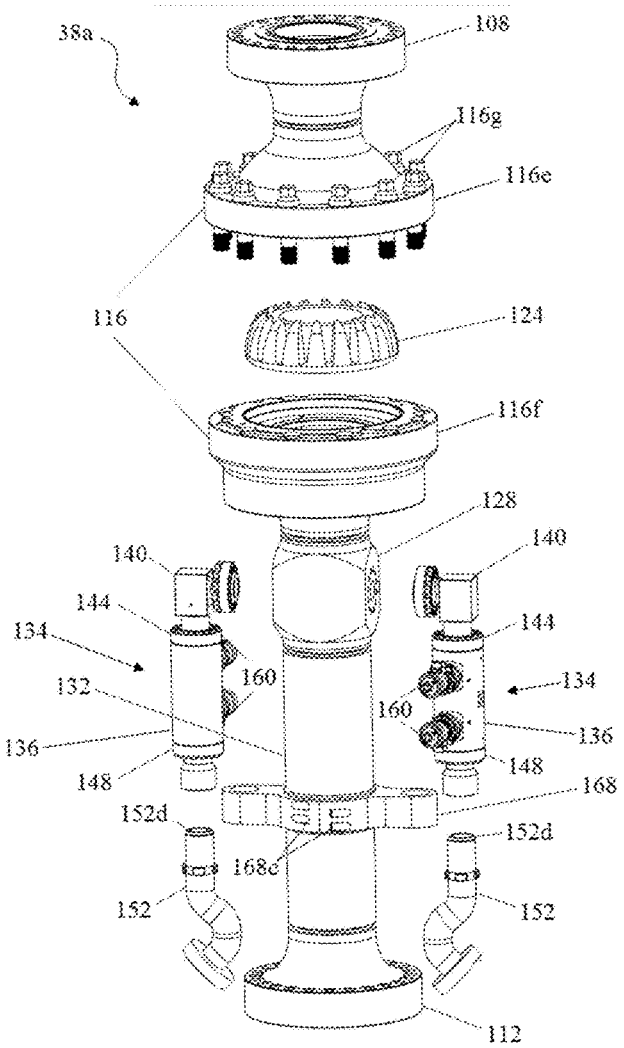
FIG. 2B depicts a partially-exploded side view of the riser-component assembly of FIG. 2A.

FIG. 2B shows components of integral riser-component assembly 38*a* as they might appear prior to assembly at a wellsite. In the orientation and configuration shown, flange 108 has been welded to the top of housing 116, the bottom of housing 116 has been welded to the top of collar 128, the top of main tube 132 has been welded to the bottom of collar 128, and the top of flange 112 has been welded to the bottom of main tube 132. An annular seal 124 can be received within a central chamber 116*c* of housing 116, as shown in FIG. 2E, prior to coupling the top and bottom portions 116*e*, 116*f*, respectively, of housing 116 together (e.g., via bolts 116*g*). Valve assemblies 134 can include valves 136 having ports 160, fittings 140, first connectors 144, and second connectors 148. The components of valve assemblies 134 can be permanently or removably coupled together in the configuration shown in FIG. 2B, as more fully described with reference to FIG. 2E below. Fittings 140 of valve assemblies 134 can be coupled to collar 128 over lateral openings 120*a* (see FIG. 2E) via, e.g., bolts. Retainer 168 can be coupled to main tube 132 permanently (e.g., via welding) or removably (e.g., via bolts through cut-outs 168*c*). In this configuration, retainer 168 should be coupled to main tube 132 such that it is entirely below the lower-most portion of valve assemblies 134. First flow lines 152 can be coupled to valve assemblies 134 by inserting pin ends 152*d* through passages 168*a* (see FIG. 2F) of retainer 168 and into recesses 148*b* (see FIG. 2F) of second connectors 148. Valves 136 can be connected to other types of flow lines such as a choke line or kill line through ports 160. Valves 136 can control the flow of fluid from primary lumen 104*a* through first flow lines 152.

Figure 2C:
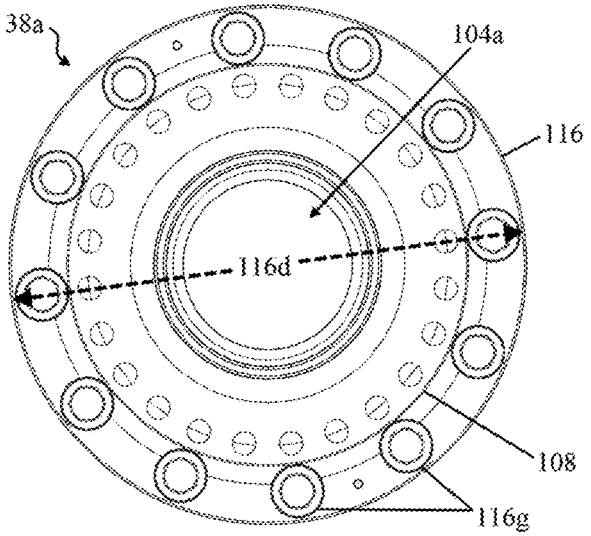
FIG. 2C depicts a top view of the riser-component assembly of FIG. 2A.
Figure 2D:
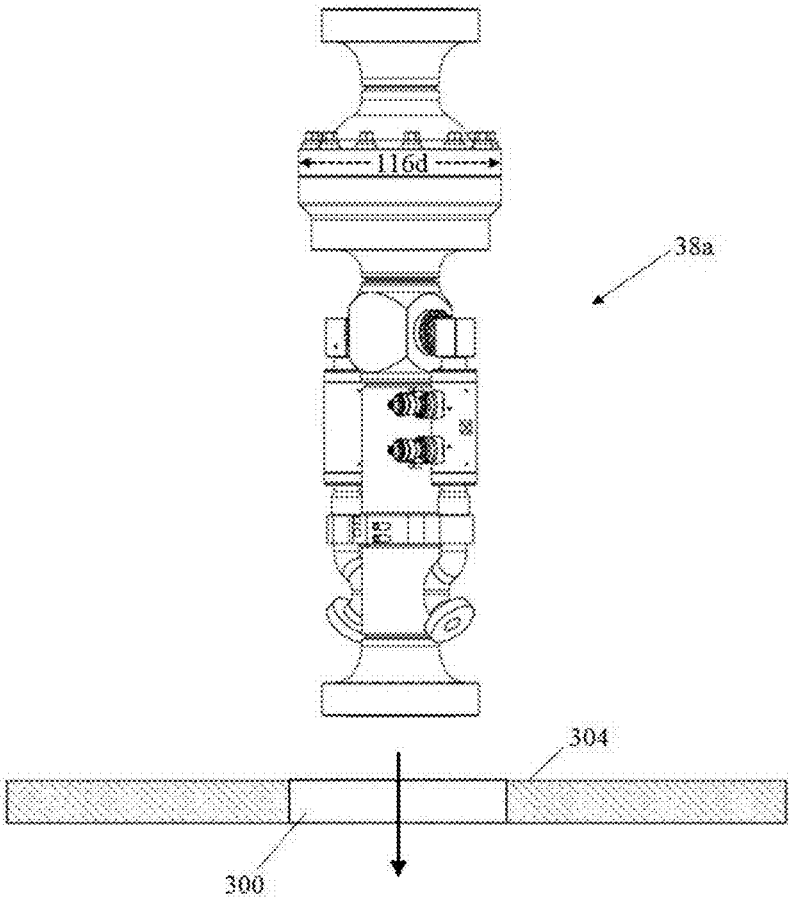
FIG. 2D depicts a side view of the riser-component assembly of FIG. 2A being lowered through a rotary according to some embodiments of the present disclosure.

As shown in FIGS. 2C and 2D, integral riser-component assembly 38*a* can have a maximum transverse diameter 116*d* (e.g., defined in housing 116 for the embodiment shown) that is less than the transverse diameter of an opening, such as opening 300 of rotary 304, such that integral riser-component assembly 38*a* can fit through a rotary such as rotary 304. In particular, maximum transverse diameter 116*d* can be less than 60.5 inches, which is a common diameter for a rotary on various drilling rigs (often referred to as a 60-inch rotary). Other embodiments of integral riser-component assembly 38*a* can have a different maximum transverse diameter (e.g., greater than 60.5 inches).

As shown in the cross-sectional view of FIG. 2E, flanges 108, 112 can include central flange lumens 108*a*, 112*a*, respectively, that can be in fluid communication with primary lumen 104*a*. Housing 116 can include first opening 116*a*, second opening 116*b*, and central chamber 116*c*, that can each be in fluid communication with primary lumen 104*a*. Central chamber 116*c* can receive annular seal 124 around primary axis 104. Annular seal 124 can be configured to seal around tubing, such as a drill string, that is axially run through central chamber 116*c* around primary axis 104.

Flow spool 120 can include lateral openings 120*a* in collar 128 that can be in fluid communication with primary lumen 104*a*. Fittings 140 can each include a fitting lumen 140*a* and be disposed at one end over lateral openings 120*a* such that fitting lumens 140*a* are in fluid communication with lateral openings 120*a* and primary lumen 104*a*. Fittings 140 can define a shoulder such that a portion of fitting lumens 140*a* have a longitudinal flow axis that runs substantially parallel to primary axis 104. Valves 136, which can a known type of valve such as a double ball valve, can be coupled to fittings 140 directly or via a connector, such as first connector 144, such that fitting lumens 140*a* are in fluid communication with valves 136. For example, first connectors 144 can include first connector lumens 144*a* that are in fluid communication with both fitting lumens 140*a* and valves 136. First connectors 144 can be permanently connected (e.g., via welding) or removably connected (e.g., via bolts or threading) to fittings 140 on one end and permanently (e.g., via welding) or removably coupled (e.g., via bolts or threading) to valves 136 on another end. Valves 136 can each include a longitudinal flow axis 136*a* that can be substantially parallel to primary axis 104. This configuration can advantageously reduce the transverse diameter of flow spool 120 so that flow spool 120 can fit through a rotary or other mechanism as shown in FIG. 2D (e.g., so that the maximum transverse diameter of flow spool 120 is less than or equal to maximum transverse diameter 116*d*).

Valves 136 can also be coupled (e.g., on the end opposite first connectors 144 and/or fittings 140) to first flow lines 152 directly or via a connector such as second connector 148 such that first flow line lumens 152*a* are in fluid communication with valves 136. For example, second connectors 148 can include second connector lumens 148*a* that are in fluid communication with both valves 136 and first flow line lumens 152*a*. Second connectors 148 can be permanently connected (e.g., via welding) or removably connected (e.g., via bolts or threading) to valves 136 on one end. While another end of second connectors 148 can be permanently connected (e.g., via welding) or removably coupled via bolts and/or threads to first flow lines 152, second connectors 148 can also be coupled to first flow lines 152 by receiving a portion of pin ends 152*d* of first flow lines 152 in recesses 148*b* of second connectors 148, as shown more clearly in FIG. 2F. In this configuration, second connectors 148 can further include grooves 148*c* sized to receive sealing and/or lubricating components (e.g., O-rings, rigid washers, grease) to facilitate insertion of a portion of pin ends 152*d* in recesses 148*b* of second connectors 148.

When connected, fluid can enter first flow line lumens 152*a* from valves 136 in a first direction, such as direction 152*b*, and exit first flow line lumens 152*a* in a second direction that is different than the first direction, such as directions 152*c*. First flow lines 152 can include flange portions 152*e* near or at their exit. Flange portions 152*e* can facilitate coupling of first flow lines 152 to second flow lines (not shown), such as auxiliary lines. The second flow lines can be attached to first flow lines 152 after integral riser-component assembly 38*a* passes through a rotary (e.g., as shown in FIG. 2D). The second flow lines can have a lumen with an inlet that can receive fluid from first flow line lumens 152*a* in direction 152*c*. This configuration (i.e., having fluid exit first flow line lumens 152*a* and enter the second flow line lumens in direction 152*c*) allows the second flow lines to be coupled to first flow lines 152 without interfering with other riser segments, such as a riser segment coupled to mating face 112*b* of flange 112. Such an advantageous configuration can be accomplished without increasing the transverse diameter of flow spool 120 (e.g., so that flow spool 120 can have a maximum transverse diameter less than maximum transverse diameter 116*d*) by including curvilinear portions such as curvilinear portions 152*f*, 152*g*, in first flow lines 152. For example, curvilinear portion 152*f* can curve toward main tube 132 and curvilinear portion 152*g* can curve away from main tube 132 such that fluid is directed in directions 152*c* without increasing the transverse diameter of flow spool 120.

Figure 2F:
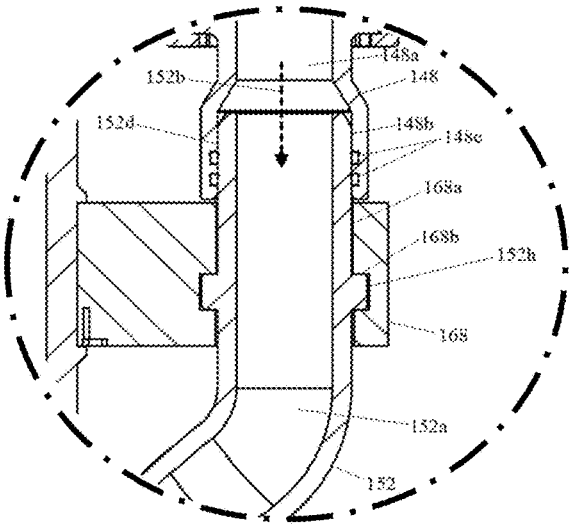
FIG. 2F depicts an enlarged cross-sectional view of a portion of the riser-component assembly of FIG. 2A, as indicated by region 2F in FIG. 2E.
Figure 2E:
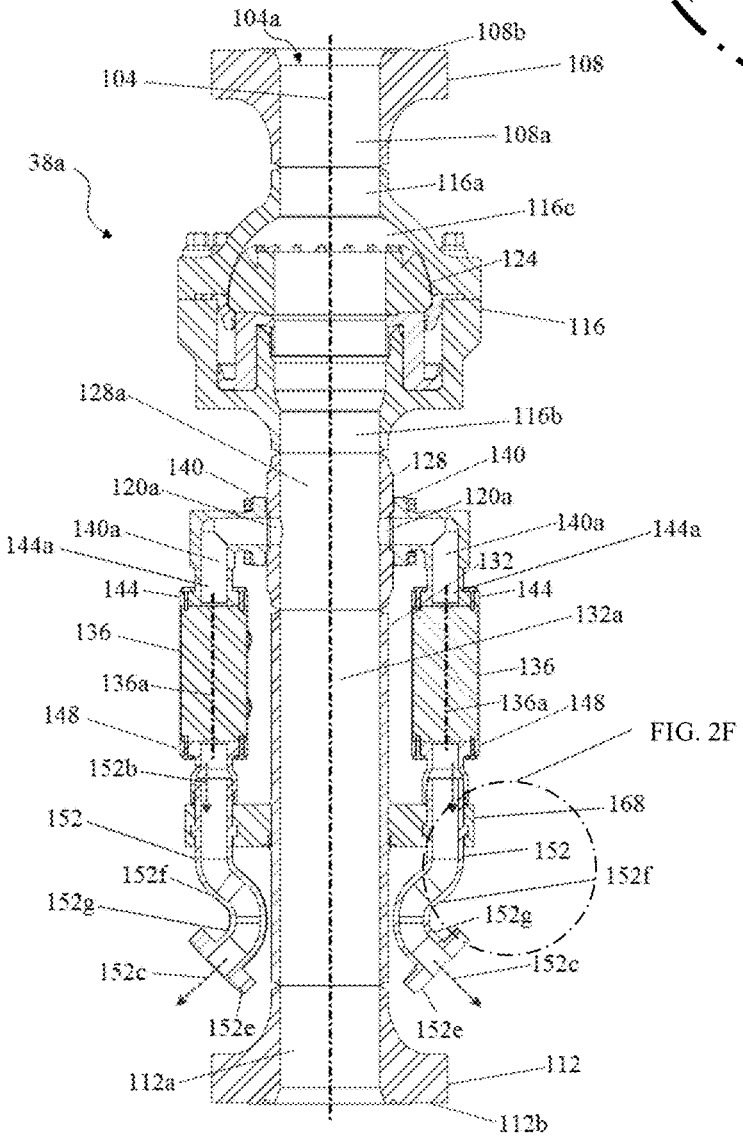
FIG. 2E depicts a cross-sectional view of the riser-component assembly of FIG. 2A.

As shown more clearly in FIG. 2F, first flow lines 152 can be secured to main tube 132 via retainer 168. Retainer 168 can include passages 168*a* that can receive a portion of pin ends 152*d* of first flow lines 152. Pin ends 152*d* of first flow lines 152 can include protrusions 152*h* that can mate with indents 168*b* of retainer 168 to ensure that first flow lines 152 are properly aligned within passages 168*a*. Retainer 168 can prevent valve assemblies 134 from moving laterally (e.g., bending) during riser operations or otherwise.

Figure 3A:
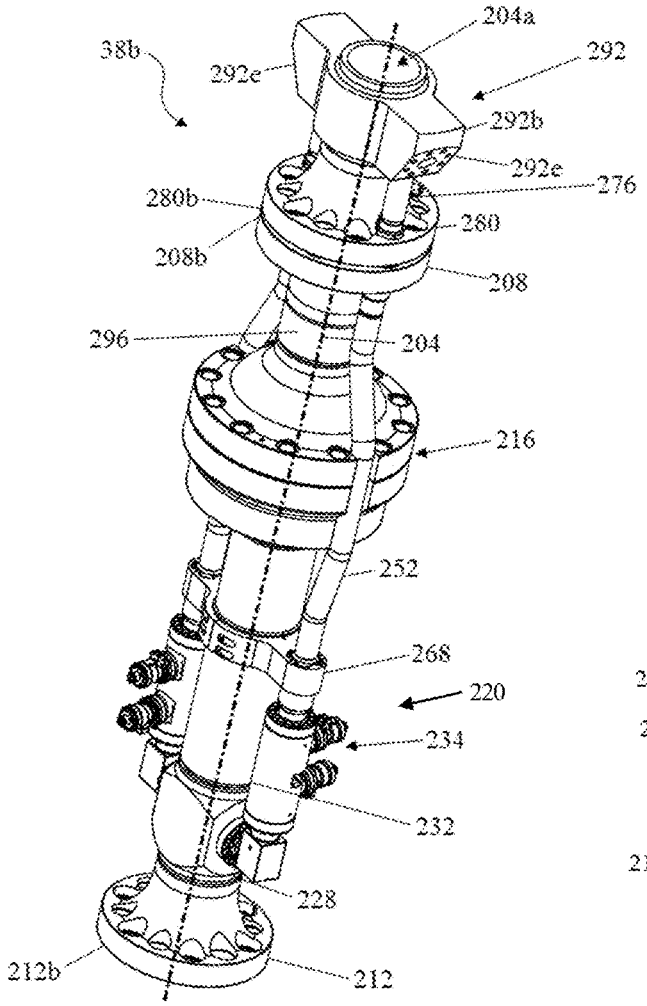
FIG. 3A depicts a perspective view of another embodiment of the present riser-component assemblies that includes an integral isolation tool and flow spool component.

FIGS. 3A-3G depict another embodiment of the riser-component assemblies that allows auxiliary or other lines to be connected to the flow spool portion of the assembly above the isolation tool portion of the assembly, which may be advantageous in certain operations. FIG. 3A shows integral riser-component assembly 38*b*, which comprises a first flange 208, a housing 216, a flow spool 220, a second flange 212, a spacer collar 296, a diversion collar assembly 292, and a third flange 280. Flanges 208, 212, and 280 can include mating faces 208*b*, 212*b*, 280*b*, respectively, that can be configured to mate with adjacent riser segments or with each other. A fourth flange (not shown) may be coupled to diversion collar assembly 292 on the opposite side of flange 280 and may include a mating face configured to mate with an adjacent riser segment. Diversion collar assembly 292 can be permanently coupled (e.g., via welding) to flange 280; mating face 280*b* of flange 280 can be removably coupled (e.g., via bolts) to mating face 208*b* of flange 208; flange 208 can be permanently coupled to spacer collar 296, spacer collar 296 can be permanently coupled to housing 216; housing 216 can be permanently coupled to flow spool 220; and flow spool 220 can be permanently coupled to flange 212. As used herein, the term "permanently coupled" means not easily removable and includes coupling by welding, but does not include coupling by only removable fasteners (e.g., screws, bolts) or coupling by only removable threading (e.g., threading on the interior and/or exterior of adjacent tubulars). Integral riser-component assembly 38*b* can include primary axis 204 and primary lumen 204*a*, which can be in fluid communication with a lumen of adjacent riser-components. Flow spool 220 can include collar 228, main tube 232, valve assemblies 234, first flow lines 252 and retainer 268. Diversion collar assembly 292 can include diversion collar 292*b* and second flow lines 276. The components of flow spool 220 and diversion collar assembly 292 are described more fully with reference to FIGS. 3B-3G below.

Figure 3B:
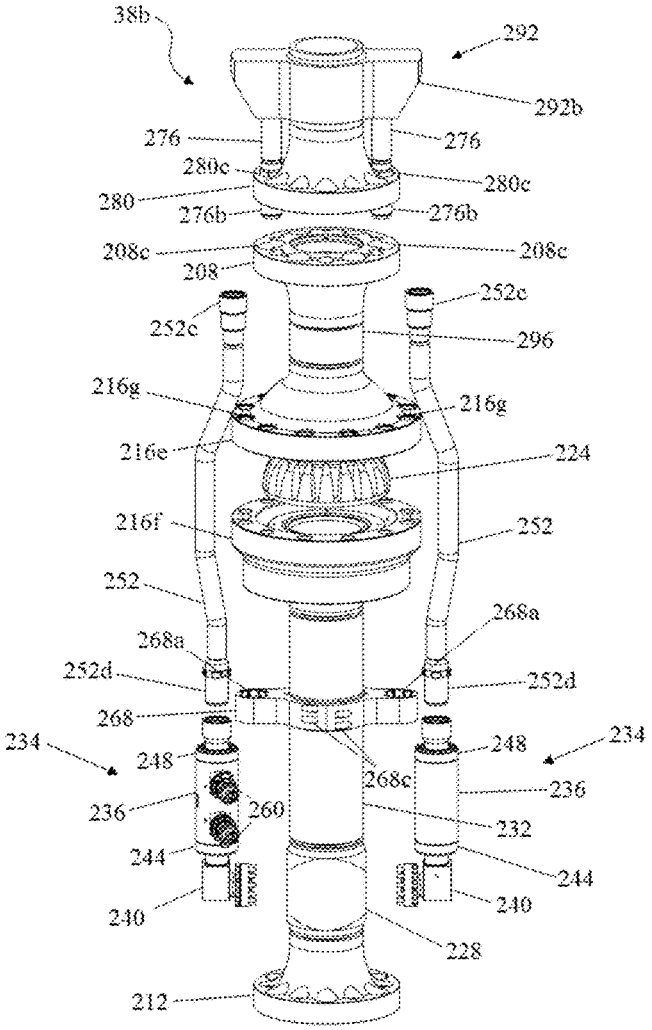
FIG. 3B depicts a partially-exploded side view of the riser-component assembly of FIG. 3A.

FIG. 3B shows components of integral riser-component assembly 38*b* as they might appear prior to assembly at a wellsite. In the orientation and configuration shown, the bottom of diversion collar 292*b* has been welded to the top (i.e., not mating face 280*b*) of flange 280, the bottom of flange 208 (i.e., not mating face 208*b*) has been welded to the top of spacer collar 296, the bottom of spacer collar 296 has been welded to the top of housing 216, the bottom of housing 216 has been welded to the top of collar 228, the bottom of collar 228 has been welded to the top of main tube 232, and the bottom of main tube 232 has been welded to the top (i.e., not mating face 212*b*) of flange 212. An annular seal 224 can be received within central chamber 216*c* of housing 216, as shown in FIG. 3E, prior to coupling the top and bottom portions 216*e*, 216*f*, respectively, of housing 216 together (e.g., via bolts). A portion of first flow lines 252 can be laterally offset from primary axis 204 and can be received within passages 216*g* of housing 216 (which can be different than holes for bolts) such that the maximum transverse diameter of riser-component assembly 38*b* is maximum transverse diameter 216*d*, as described more fully with reference to FIGS. 2C and 2D below. Spacer collar 296 can have an axial length sufficient to permit alignment of first flow lines 252 and second flow lines 276 above housing 216.

Valve assemblies 234 can include valves 236 having ports 260, fittings 240, first connectors 244, and second connectors 248. The components of valve assemblies 234 can be permanently coupled (e.g., via welding) or removably coupled (e.g., via bolts) together in the configuration shown in FIG. 3B and are more fully described with reference to FIG. 3E below. Fittings 240 of valve assemblies 234 can be coupled to collar 228 over lateral openings 220*a* (see FIG. 3E) via, e.g., bolts. Retainer 268 can be coupled to main tube 232 permanently (e.g., via welding) or removably (e.g., via bolts through cut-outs 268*c*). In this configuration, retainer 268 should be coupled to main tube 232 such that retainer 268 is entirely above the highest portion of valve assemblies 234. First flow lines 252 can be coupled to valve assemblies 234 by inserting pin ends 252*d* of first flow lines 252 through passages 268*a* of retainer 268 and into recesses 248*b* (see FIG. 2F) of second connectors 248. Valves 236 can be connected to other types of flow lines such as a choke line or kill line through ports 260. Valves 236 can control the flow of fluid from primary lumen 204*a* through first flow lines 252.

Second flow lines 276 of diversion collar assembly 292 can have ends permanently coupled (e.g., via welding) or removably coupled (e.g., via bolts and/or threads) to diversion collar 292*b*. Second flow lines can also include pin ends 276*b*, a portion of which can be received in peripheral flange lumen 280*c* of flange 280, as shown in FIG. 3B. While second flow lines 276 can be coupled to first flow lines 252 permanently (e.g., via welding) or removably via bolts and/or threads, second flow lines 276 can also be coupled to first flow lines 252 removably by inserting a portion of pin ends 276*b* of second flow lines 276 through peripheral flange lumens 208*c* of flange 208 (e.g., after first being inserted through peripheral flange lumens 280*c* of flange 280) and into recesses 252*b* (see FIG. 3G) of box ends 252*c* of first flow lines 252, as described more fully by reference to FIGS. 3E and 3G below.

Figure 3C:
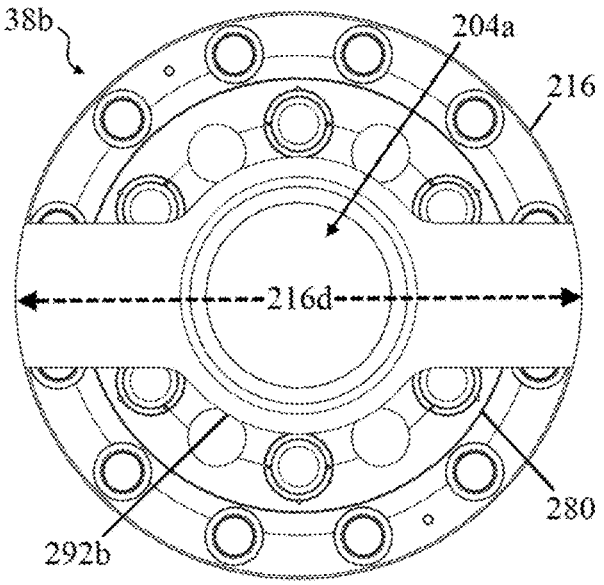
FIG. 3C depicts a top view of the riser-component assembly of FIG. 3A.
Figure 3D:
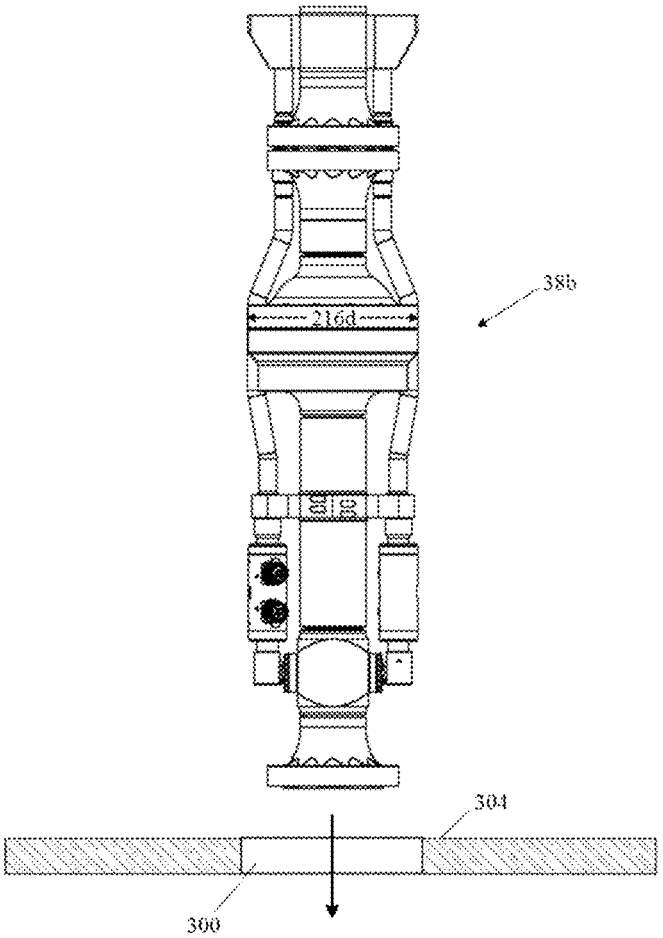
FIG. 3D depicts a side view of the riser-component assembly of FIG. 3A being lowered through a rotary according to some embodiments of the present disclosure.
Figure 3E:
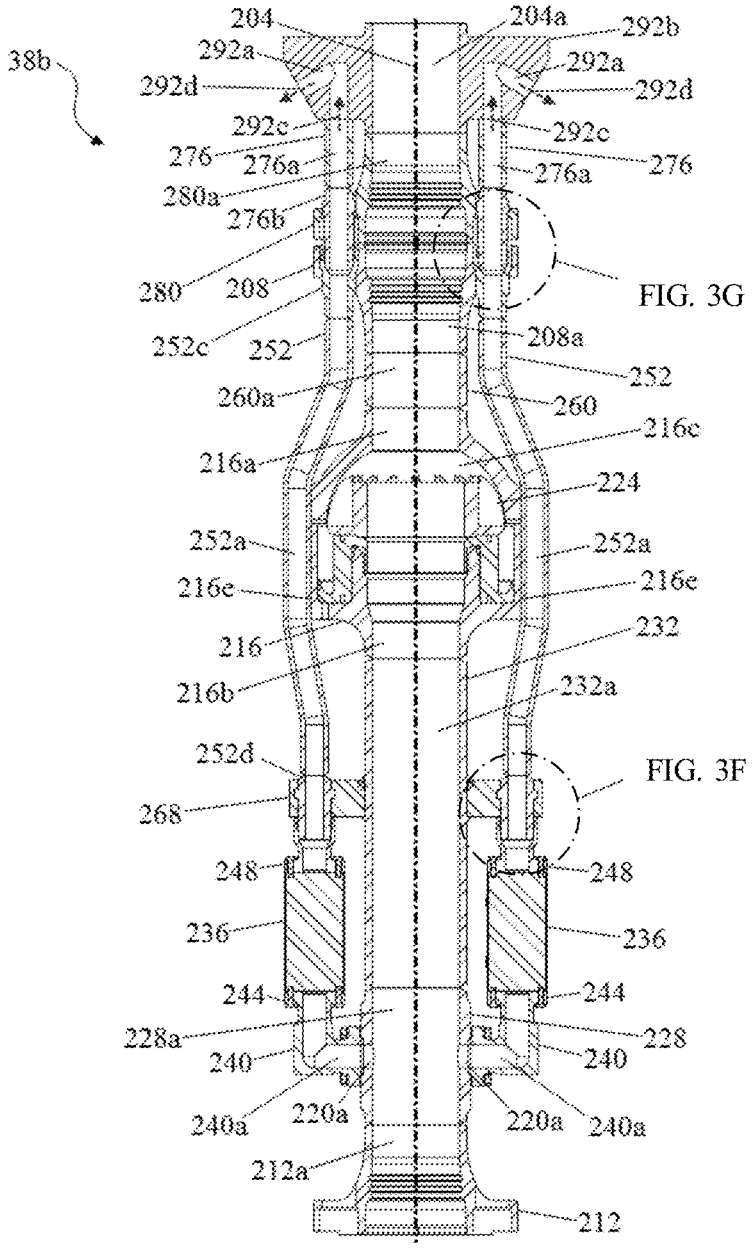
FIG. 3E depicts a cross-sectional view of the riser-component assembly of FIG. 3A.
Figure 3G:
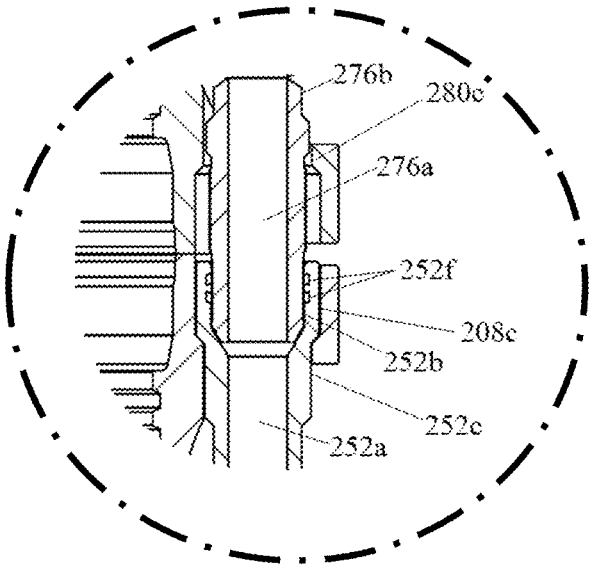
FIGS. 3F and 3G depict enlarged cross-sectional views of portions of the riser-component assembly of FIG. 3A, as indicated by regions 3F and 3G in FIG. 3E.

As shown in FIGS. 3C and 3D, integral riser-component assembly 38*b* can have a maximum transverse diameter 216*d* (e.g., defined in housing 216 for the embodiment shown) that is less than the transverse diameter of an opening, such as opening 300 of rotary 304, such that integral riser-component assembly 38*b* can fit through a rotary such as rotary 304. In particular, maximum transverse diameter 216*d* can be less than 60.5 inches, which is a common diameter for a rotary on various drilling rigs (often referred to as a 60-inch rotary). Other embodiments of integral riser-component assembly 38*b* can have a different maximum transverse diameter (e.g., greater than 60.5 inches).

As shown in the cross-sectional view of FIG. 3E, flanges 208, 212, 280 can include central flange lumens 208*a*, 212*a*, 280*a*, respectively, that can be in fluid communication with primary lumen 204*a*. Housing 216 can include first opening 216*a*, second opening 216*b*, and central chamber 216*c*, that can each be in fluid communication with primary lumen 204*a*. Central chamber 216*c* can receive annular seal 224 around primary axis 204. Annular seal 224 can be configured to seal around tubing, such as a drill string, that is axially run through central chamber 216*c* around primary axis 204.

Flow spool 220 can include lateral openings 220*a* in collar 228 that can be in fluid communication with primary lumen 204*a*. Fittings 240 can each include a fitting lumen 240*a* and be disposed at one end over lateral openings 220*a* such that fitting lumens 240*a* are in fluid communication with lateral openings 220*a* and primary lumen 204*a*. Fittings 240 can define a shoulder such that a portion of fitting lumens 240*a* have a longitudinal flow axis that runs substantially parallel to primary axis 204. Valves 236, which can be a known type of valve such as a double ball valve, can be coupled to fittings 240 directly or via a connector, such as first connector 244, such that fitting lumens 240*a* are in fluid communication with valves 236. For example, first connectors 244 can include first connector lumens 244*a* that are in fluid communication with both fitting lumens 240*a* and valves 236. First connectors 244 can be permanently connected (e.g., via welding) or removably connected (e.g., via bolts or threading) to fittings 240 on one end and permanently (e.g., via welding) or removably coupled (e.g., via bolts or threading) to valves 236 on another end. Valves 236 can each include a longitudinal flow axis 236*a* that can be substantially parallel to primary axis 204. This configuration can advantageously reduce the transverse diameter of flow spool 220 so that flow spool 220 can fit through a rotary or other mechanism as shown in FIG. 3D (e.g., so that the maximum transverse diameter of flow spool 220 is less than or equal to maximum transverse diameter 216*d*).

Valves 236 can also be coupled (e.g., on the end opposite first connectors 244 and/or fittings 240) to first flow lines 252 directly or via a connector such as second connector 248 such that first flow line lumens 252*a* are in fluid communication with valves 236. For example, second connectors 248 can include second connector lumens 248*a* that are in fluid communication with both valves 236 and first flow line lumens 252*a*. Second connectors 248 can be permanently connected (e.g., via welding) or removably connected (e.g., via bolts or threading) to valves 236 on one end. While another end of second connectors 248 can be permanently connected (e.g., via welding) or removably coupled via bolts and/or threads to first flow lines 252, second connectors 248 can also be coupled to first flow lines 252 by receiving a portion of pin ends 252*d* of first flow lines 252 in recesses 248*b* of second connectors 248, as shown more clearly in FIG. 3F. In this configuration, second connectors 248 can further include grooves 248*c* sized to receive sealing and/or lubricating components (e.g., O-rings, rigid washers, grease) to facilitate insertion of a portion of pin ends 252*d* in recesses 248*b* of second connectors 248.

When connected, fluid can enter first flow lines 252 through pin ends 252*d* from valves 236 and exit first flow lines 252 through box ends 252*c*. As shown more clearly in FIG. 3G, recesses 252*b* of box ends 252*c* can receive a portion of pin ends 276*b* of second flow lines 276 such that first flow line lumens 252*a* and second flow line lumens 276*a* are in fluid communication. In this configuration, box ends 252*c* can further include grooves 252*f* sized to receive sealing and/or lubricating components (e.g., O-rings, rigid washers, grease) to facilitate insertion of a portion of pin ends 276*b* of second flow lines 276 in recesses 252*b* of first flow lines 252. Another end of second flow lines 276 (e.g., the end spaced apart from pin end 276*b* can be permanently coupled (e.g., via welding) or removably coupled (e.g., via bolts or threading) to diversion collar 292*b* of diversion collar assembly 292 such that second flow line lumens 276*a* are in fluid communication with diversion collar lumens 292*a*.

When connected, fluid can enter diversion collar lumens 292*a* from second flow line lumens 276*a* in a first direction, such as direction 292*c*, and exit diversion collar lumens 292*a* in a second direction that is different than the first direction, such as directions 292*d*. Diversion collar 292*b* can be coupled to third flow lines (not shown), such as an auxiliary line, via, e.g., bolts at joining surfaces 292*e* (see FIG. 3A). The third flow lines can be attached to diversion collar 292*b* after integral riser-component assembly 38*b* passes through a rotary (e.g., as shown in FIG. 3D). The third flow lines can have a lumen with an inlet that can receive fluid from diversion collar lumens 292*a* in direction 292*d*. This configuration (i.e., having fluid exit first diversion collar lumens 292*a* and enter the third flow line lumens in direction 292*d*) allows the third flow lines to be coupled to diversion collar 292*b* without interfering with other riser segments, such as a riser segment coupled above diversion collar assembly 292 in the orientation shown in FIG. 3E.

Figure 3F:
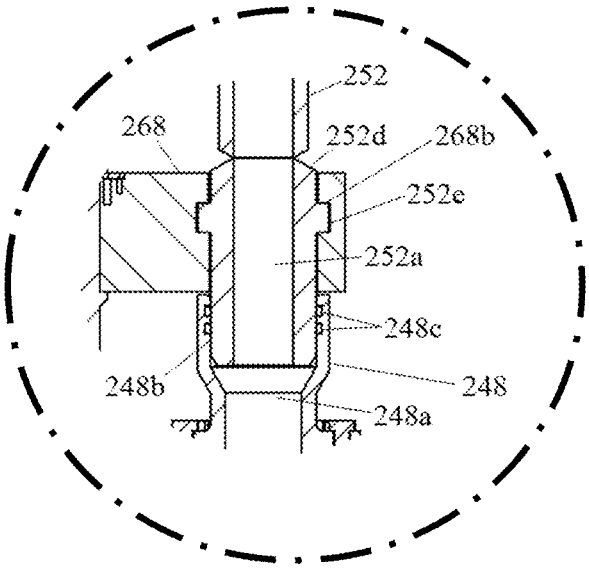

As shown in FIGS. 3E and 3F, first flow lines 252 can be secured to main tube 232 via retainer 268. Retainer 268 can include passages 268*a* that can receive a portion of pin ends 252*d* of first flow lines 252. Pin ends 252*d* of first flow lines 252 can include protrusions 252*e* that can mate with indents 268*b* of retainer 268 to ensure that first flow lines 252 are properly aligned within passages 268*a*. Retainer 268 can prevent valve assemblies 234 from moving laterally (e.g., bending) during riser operations or otherwise.

Figure 4A:
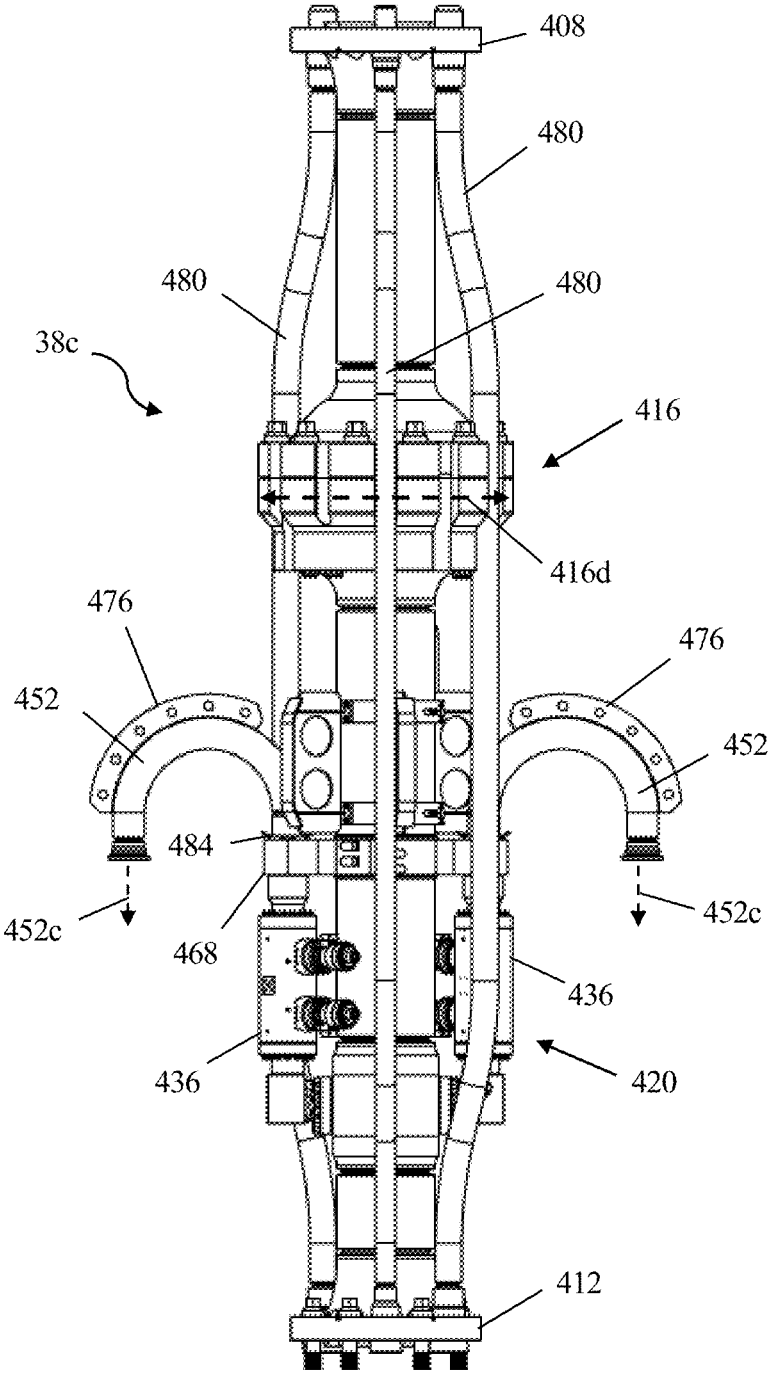
FIGS. 4A and 4B depict a side and top view, respectively, of another embodiment of the present riser-component assemblies that includes an integral isolation tool and flow spool component.
Figure 4B:
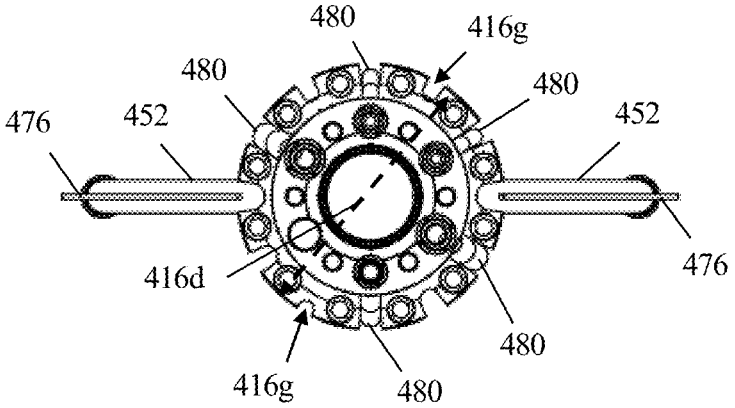

FIGS. 4A and 4B depict another embodiment of an integral riser-component assembly 38*c* that allows lines, such as auxiliary lines, to be connected to the assembly around the flow spool without increasing the maximum diameter of the assembly. As shown, assembly 38*c* includes many of the same components as previous embodiments, including a first flange 408, a housing 416, a flow spool 420, a retainer 468, and a second flange 412. These components generally operate and have the same characteristics and assembly as previously described embodiments. Housing 416 includes a plurality of passages 416*g* similar to passages 216*g* that can receive a portion (including all) of the transverse diameter of lines, such as auxiliary lines 480, such that the lines fit within the maximum transverse diameter 416*d* of housing 416. Maximum transverse diameter 416*d* is greater than or equal to the maximum transverse diameter of flow spool 420 such that assembly 38*c* can fit through a rotary or other mechanism, similar to that shown in FIGS. 2D and 3D, when gooseneck-like flow lines 452 are not connected. Flow lines 452 are similar to curvilinear flow lines 152 in that they can receive fluid from valves 436 in one direction but direct the flow out in another direction 452*c* that is different than the first direction. As shown in FIG. 4A, direction 452*c* is substantially opposite of the inlet direction (though other outlet directions are also possible). As shown in FIGS. 4A and 4B, flow lines 452 extend beyond the maximum transverse diameter 416*d* of housing 416. Accordingly, flow lines 452 may be removeably coupled to flow spools 420, for example, through threaded and/or bolted connection 484, so that they may be connected to the rest of assembly 38*c* after it passes through a rotary. Handles 476 may be coupled to flow lines 452 (e.g., via welding or integrally) to facilitate this connection. Additionally, because flow lines 452 extend beyond the maximum transverse diameter 416*d* of housing 416, they are more at risk of inadvertent contact and damage from other riser components. Accordingly, handles 476 provide some protection from such contact.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

While the above specification refers to the embodiments of integral riser-component assemblies 38*a* and 38*b*, the invention is not to be so limited. Permanent connection of other riser-components such as rotating control device (RCD) body components (e.g., RCD body component 14) is also contemplated.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A riser-component assembly having a primary lumen, the assembly comprising:

a housing having a first opening, a second opening, and defining a central chamber in fluid communication with the primary lumen and configured to receive an annular seal in the central chamber such that the annular seal can selectively seal an annulus in the central chamber around a tubing extending through the first and second openings of the housing; and a flow diverter permanently coupled to the housing, the flow diverter having:

a collar defining a lateral opening in fluid communication with the primary lumen, the collar having a collar lumen in fluid communication with the primary lumen, a main tube coupled to the collar and having a main tube lumen in fluid communication with the primary lumen, and a valve in fluid communication with the lateral opening;

wherein the housing comprises a maximum transverse dimension and a first passage within the maximum transverse dimension of the housing, the first passage configured to be circumferentially aligned with a first flow line.

2. The assembly of claim 1, comprising the first flow line, wherein the first flow line includes a first flow line lumen and at least a portion of the first flow line lumen is configured to be aligned with the first passage.

3. The assembly of claim 2, wherein the first passage is configured to at least partially receive the first flow line.

4. The assembly of claim 2, wherein the first flow line is an auxiliary line.

5. The assembly of claim 1, wherein the housing comprises a second passage within the maximum transverse dimension of the housing and wherein the second passage is configured to be circumferentially aligned with a second flow line.

6. The assembly of claim 5, comprising the second flow line having a second flow line lumen in fluid communication with the valve.

7. The assembly of claim 5, wherein the second passage is configured to at least partially receive the second flow line.

8. The assembly of claim 6, wherein the second flow line lumen has an inlet through which fluid can enter in a first direction substantially parallel to a longitudinal flow axis of the valve, and an outlet through which fluid may exit in a second direction, the second direction substantially different than the first direction.

9. The assembly of claim 1, wherein each of the maximum transverse dimension of the housing and a maximum transverse dimension of the flow diverter is sized such that each of the housing and the flow diverter can fit through a rotary of a drilling rig.

10. The assembly of claim 1, wherein the valve has a longitudinal flow axis that is more parallel than perpendicular to a longitudinal axis extending through the primary lumen.

11. The assembly of claim 1, wherein a maximum transverse dimension of the flow diverter is less than or equal to the maximum transverse dimension of the housing.

12. The assembly of claim 11, wherein the maximum transverse dimension of the housing is less than 60.5 inches.

13. A method comprising:

lowering a riser-component assembly of claim 1 through a rotary of a drilling rig.

14. A method of assembling a riser-component having a primary lumen, the method comprising:

permanently coupling a main tube of a flow diverter to a housing;

wherein the housing includes:

a first opening, a second opening, and the housing defines a central chamber in fluid communication with the primary lumen;

a maximum transverse dimension; and a first passage within the maximum transverse dimension of the housing, the first passage configured to be circumferentially aligned with a first flow line; and wherein the flow diverter includes:

a collar defining a lateral opening in fluid communication with the primary lumen, the collar having a collar lumen in fluid communication with the primary lumen, the main tube coupled to the collar and having a main tube lumen in fluid communication with the primary lumen; and a valve in fluid communication with the lateral opening.

15. The method of claim 14, wherein the first flow line includes a first flow line lumen and the method comprises aligning the first passage with at least a portion of the first flow line lumen.

16. The method of claim 15, comprising at least partially inserting the first flow line into the first passage.

17. The method of claim 14, wherein the first flow line is an auxiliary line.

18. The method of claim 14, wherein the housing comprises a second passage within the maximum transverse dimension of the housing, the second passage configured to be circumferentially aligned with a second flow line.

19. The method of claim 18, wherein the second flow line includes a second flow line lumen and the method comprises:

aligning the second passage with at least a portion of the second flow line lumen; and coupling a first end of the second flow line to the valve such that the second flow line lumen is in fluid communication with the valve.

20. The method of claim 18, comprising at least partially inserting the second flow line into the second passage.

21. The method of claim 14, comprising permanently coupling a first flange to the housing, the first flange having a first central flange lumen in fluid communication with the primary lumen and a first mating face configured to mate with a flange of a first adjacent riser segment.

22. The method of claim 14, comprising permanently coupling a second flange to the flow diverter, the second flange having a second central flange lumen in fluid communication with the primary lumen and a second mating face configured to mate with a flange of a second adjacent riser segment.

23. The method of claim 14, moving the housing and the flow diverter through a rotary of a drilling rig after coupling the main tube of the flow diverter to the housing.

24. A riser-component assembly having a primary lumen, the assembly comprising:

a housing having a first opening, a second opening, and defining a central chamber in fluid communication with the primary lumen and configured to receive an annular seal in the central chamber such that the annular seal can selectively seal an annulus in the central chamber around a tubing extending through the first and second openings of the housing; and a flow diverter coupled to the housing, the flow diverter having:

a collar defining a lateral opening in fluid communication with the primary lumen;

a main tube coupled to the collar and having a main tube lumen in fluid communication with the primary lumen; and a valve in fluid communication with the lateral opening, the valve positioned such that the lateral opening is disposed between the housing and the valve in a direction along a primary axis of the primary lumen.

25. The assembly of claim 24, wherein the collar of the flow diverter is permanently coupled to the housing.

* * * * *